US012765632B2

(12) United States Patent
Astudillo et al.

(10) Patent No.: US 12,765,632 B2
(45) Date of Patent: Oct. 20, 2026

(54) SOLE FOR A RUNNING SHOE

(71) Applicant: adidas AG, Herzogenaurach (DE)

(72) Inventors: Melanie Astudillo, Nuremberg (DE); Ulisse Tanzini, Nuremberg (DE); Thomas Pitts, Fuerth (DE); Pauline Streissel, Nuremberg (DE); Erin Bendig, Nuremberg (DE); John Thomas Newcomb, Erlangen (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 19/189,133

(22) Filed: Apr. 24, 2025

(65) Prior Publication Data

US 2025/0331602 A1 Oct. 30, 2025

(30) Foreign Application Priority Data

Apr. 29, 2024 (DE) ..... 10 2024 111 995.0

(51) Int. Cl.
*A43B 13/02* (2022.01)
*A43B 13/22* (2006.01)
*A43B 13/26* (2006.01)

(52) U.S. Cl.
CPC ..... *A43B 13/02* (2013.01); *A43B 13/22* (2013.01); *A43B 13/26* (2013.01)

(58) Field of Classification Search
CPC ..... A43B 13/02; A43B 13/22; A43B 13/26
USPC ..... 36/25 R
See application file for complete search history.

(56) References Cited

U.S. PATENT DOCUMENTS

| | | | | |
|---|---|---|---|---|
| 4,578,883 | A * | 4/1986 | Dassler | A63B 67/14 36/25 R |
| 7,168,190 | B1 * | 1/2007 | Gillespie | A43B 3/24 363/31 |
| 8,365,441 | B2 * | 2/2013 | Kirby | A43C 15/00 36/59 C |
| 8,474,155 | B2 * | 7/2013 | McDonald | A43B 13/223 36/102 |
| 9,615,625 | B1 | 4/2017 | Huard et al. | |
| 2002/0116843 | A1 * | 8/2002 | Harrison | A43B 1/00 36/84 |
| 2005/0210710 | A1 * | 9/2005 | Chen | A43B 3/26 36/97 |

(Continued)

FOREIGN PATENT DOCUMENTS

| | | |
|---|---|---|
| DE | 60220462 T2 | 7/2007 |
| EP | 2180805 B1 | 3/2017 |

(Continued)

OTHER PUBLICATIONS

Office Action, German Patent Application No. 10 2024 111 995.0, Feb. 5, 2025, 8 pages.

(Continued)

*Primary Examiner* — Marie D Bays
(74) *Attorney, Agent, or Firm* — Kilpatrick Townsend & Stockton LLP

(57) ABSTRACT

The present disclosure relates to a sole for a shoe, in particular for a sports shoe such as a running shoe, comprising (a) a midsole, and (b) at least one ground-contacting support element comprising a foam material and being distinct from the midsole, (c) wherein the foam material of the at least one ground-contacting support element is stiffer than a midsole material.

19 Claims, 2 Drawing Sheets

(56) References Cited

U.S. PATENT DOCUMENTS

| | | | | |
|---|---|---|---|---|
| 2015/0250260 | A1 | 9/2015 | Bessho et al. | |
| 2017/0295886 | A1* | 10/2017 | Davis | A43B 13/187 |
| 2018/0242687 | A1* | 8/2018 | Granger | A43B 7/143 |
| 2019/0223553 | A1* | 7/2019 | Lussier | A43B 13/26 |
| 2020/0329812 | A1 | 10/2020 | Le et al. | |
| 2021/0321714 | A1* | 10/2021 | Yamade | A43B 13/122 |
| 2021/0392992 | A1* | 12/2021 | Duffy | A43B 5/001 |
| 2022/0192314 | A1* | 6/2022 | Susko | A43B 13/26 |

FOREIGN PATENT DOCUMENTS

| | | | |
|---|---|---|---|
| EP | 3868242 | A2 | 8/2021 |
| EP | 4154749 | A1 | 3/2023 |
| WO | 2007/043651 | A1 | 4/2007 |
| WO | 2023/278486 | A1 | 1/2023 |

OTHER PUBLICATIONS

European Extended Search Report, European Patent Application No. 25173203.8, Aug. 25, 2025, 10 pages.

"What is Rubber Durometer, and How Does it Relate to Isolator Stiffness?", https://hutchinsonai.com/wp-content/uploads/2020/01/Durometer-vs-Stiffness.pdf; retrieved on Aug. 11, 2025, Jan. 1, 2020, 2 pages.

* cited by examiner

SOLE FOR A RUNNING SHOE

CROSS REFERENCE TO RELATED APPLICATION

This application is related to and claims priority benefits from German Patent Application No. DE 10 2024 111 995.0, filed on Apr. 29, 2024, entitled Sole for a Running Shoe ("the '995 application"). The '995 application is hereby incorporated herein in its entirety by this reference.

FIELD OF THE INVENTION

The present invention relates to a sole for a shoe, in particular for a sports shoe such as a running shoe. The sole comprises a midsole and at least one ground-contacting support element comprising a foam material and being distinct from the midsole, wherein the foam material of the at least one ground-contacting support element is stiffer than a midsole material.

The present invention also relates to a shoe comprising such a sole.

BACKGROUND

A shoe is commonly described as the combination of an upper and a sole. Typically, the upper covers regions such as the instep, the toe, the medial side, the lateral side, and the heel of a wearer's foot and provides an opening to allow the wearer to step inside the footwear. The sole is connected to the upper such that the sole's top side faces an underfoot portion of the upper, and its bottom side touches the ground during ordinary use of the shoe.

A sole typically performs several different functions, such as cushioning the impact forces that occur when the foot strikes the ground and providing traction to prevent the wearer's foot from slipping. Another function that a sole typically performs is to provide a degree of stability to the wearer's foot so that the risk of twisting an ankle or other types of injury, such as plantar fascia injury, muscle strain, etc., is reduced. Another function of a sole, particularly for performance footwear such as running shoes, is to facilitate good transmission of forces from the athlete's legs through the feet to the ground and an efficient running style to improve the athlete's performance.

To address the aforementioned stability and performance issues in running shoes, supporting elements like shank elements, torsion systems, stiffening plates, etc. have been considered. However, a weakness of these constructions is that they result in shoes with high rigidity and stiffness, which leads to a running experience that is not very pleasant or comfortable from a user perception perspective.

The sole typically includes a midsole and an outsole. The midsole is usually made of a foam material or a resiliently deformable foam material. The midsole is typically interposed between an insole, a sockliner, optionally a strobel board, and the outsole and may provide for sufficient cushioning and energy return to the wearer. The outsole may provide for ground contact and is often made of a durable and wear-resistance material like rubber. In some cases, an outsole is provided with means to improve traction to the ground. For instance, outsoles may be provided with at least one cleat, stud, spike, or the like.

Exemplarily, the following prior art documents may be mentioned in the context of the present disclosure.

Prior art document WO 2023/278486 A1 relates to a sole structure with a foam element extending from a forefoot region to a heel region. A bottom surface of the foam element includes a recess formed in the forefoot region. The sole structure also includes a cushioning arrangement disposed in the recess of the foam element. The cushioning arrangement has a proximal end adjacent to the bottom surface of the foam element and a distal end formed on an opposite side of the cushioning arrangement than the proximal end, the cushioning arrangement including at least one medial bladder proximate to a medial side of the sole structure and at least one lateral bladder proximate to a lateral side of the sole structure. An outsole includes an anterior outsole and a posterior outsole attached to the bottom surface of the foam element and the distal end of the cushioning arrangement. The anterior outsole is spaced apart from the posterior outsole.

Prior art document EP 2 180 805 B1 is directed to an article of footwear with an upper and a sole structure secured to the upper. The sole structure has a plurality of support elements, and each of the support elements include a shell and a core. The shell defines an interior void and is formed from a polymer material that extends around substantially all of the void. The core has a shape of the void and is located within the void, with at least a portion of the core being a polymer foam material. The polymer foam material of at least two of the support elements may have different densities.

Prior art document EP 3 868 242 A2 of the applicant relates to a sole for a shoe, in particular for a running shoe, which comprises at least two reinforcing members extending in a front half of the sole, wherein at least a first one of the reinforcing members further extends rearwardly beyond the midfoot area and into a heel area of the sole and wraps up to a posterior portion of the ankle region.

While the above documents claimed improvement over the known prior art thus far, the proposed solutions of said documents still have some deficiencies when it comes to providing the above noted requirements to a sole. One common disadvantage of the known supporting elements is that no high traction and durability for the outsole usage are provided.

Against this background, it is an object of the present invention to provide an improved sole for a shoe.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

In some aspects, the present disclosure is directed to: a sole (100) for a shoe, in particular for a sports shoe such as a running shoe, comprising: (a) a midsole (110); and (b) at least one ground-contacting support element comprising a foam material and being distinct from the midsole: (c) wherein the foam material of the at least one ground-contacting support element is stiffer than a midsole material. The at least one ground-contacting support element may provide at least 40%, e.g., at least 50%, at least 60%, at least 70%, or at least 80% of a ground-contacting surface of the sole. The foam material of the at least one ground-contacting support element may comprise at least one of the following materials: ethylene-vinyl-acetate, EVA, or Ethylene Propylene Diene Monomer, EPDM. In some aspects, the foam material of the at least one ground-contacting support element comprises a hardness of between 40 and 75 Shore C, e.g., of between 45 and 70 Shore C, approximately 48 Shore C or approximately 60 Shore C or approximately 65 Shore C, wherein the hardness is larger than of the midsole. In some aspects, the midsole material comprises a foam material. The midsole material may comprise at least one of the following materials: a particle foam such as comprising at least one of the following materials: expanded thermoplastic polyurethane, eTPU, expanded polyamide, ePA, expanded polyether-block-amide, ePEBA, expanded thermoplastic polyester ether elastomer, eTPEE, expanded polylactide, ePLA, expanded polyethylene terephthalate, ePET, expanded polybutylene terephthalate, ePBT, and expanded thermoplastic olefin, eTPO: a block foam such as comprising at least one of the following materials: thermoplastic polyurethane, TPU, polyamide, PA, polyether-block-amide, PEBA, thermoplastic polyester ether elastomer, TPEE, polylactide, PLA, polyethylene terephthalate, PET, polybutylene terephthalate, PBT, and thermoplastic olefin TPO, ethylene-vinyl-acetate EVA, or combinations thereof. The at least one ground-contacting support element comprises a material with reinforcement, such as a material with fibers. The at least one ground-contacting support element may be rod-shaped. The at least one ground-contacting support element may be formed by at least one of the following manufacturing processes: injection molding or compression molding. The at least one ground-contacting support element may be glued onto the midsole. A width of the at least one ground-contacting support element may vary along said at least one ground-contacting support element. The at least one ground-contacting support element may be rod-shaped and extends substantially parallel to the longitudinal extension direction of the sole. The at least one ground-contacting support element may have a length of at least 15 cm, e.g., of at least 21 cm, and/or a width of at least 5 mm, e.g., of at least 9 mm. In some aspects, the at least one ground-contacting support element is not inserted in the midsole. In some aspects, the at least one ground-contacting support element may be at least partly inserted in the midsole. In some aspects, the midsole has at least one recess for receiving the at least one ground-contacting support element partially therein, such that the at least one ground-contacting support element protrudes from a surface of the midsole. The at least one ground-contacting support element may protrude at least 3 mm, e.g., at least 3.5 mm, from the midsole. The at least one ground-contacting support element may be designed to allow at least one of the following functions: increase the traction of the sole, increase durability of the sole, increased wearing comfort, increased support of the sole, reduced weight of the sole, increased cushioning, increased energy return. The at least one ground-contacting support element may have a shape comprising a localized low point relative to a horizontal plane, and wherein the localized low point is in the forefoot region of the sole. The at least one ground-contacting support element may extend into the forefoot region of the sole. The at least one ground-contacting support element may further extend rearwardly into the midfoot region of the sole. The at least one ground-contacting support element may further extend rearwardly and into the heel region of the sole. The at least one ground-contacting support element may further extends into the medial and/or lateral region of the sole. In some aspects, the sole comprises at least two, e.g., at least three support elements, each support element being rod-shaped. In some aspects, at least two, e.g., at least three, ground-contacting support elements are tapered. There may be exactly five ground-contacting support elements, each corresponding to a respective metatarsal bone.

In some embodiments, the present disclosure is directed to a shoe, in particular a sports shoe such as a running shoe, comprising a sole as described in the preceding paragraph.

BRIEF DESCRIPTION OF THE DRAWINGS

In the following detailed description, embodiments of the invention are described referring to the following figures.

BRIEF DESCRIPTION

Figure 1:
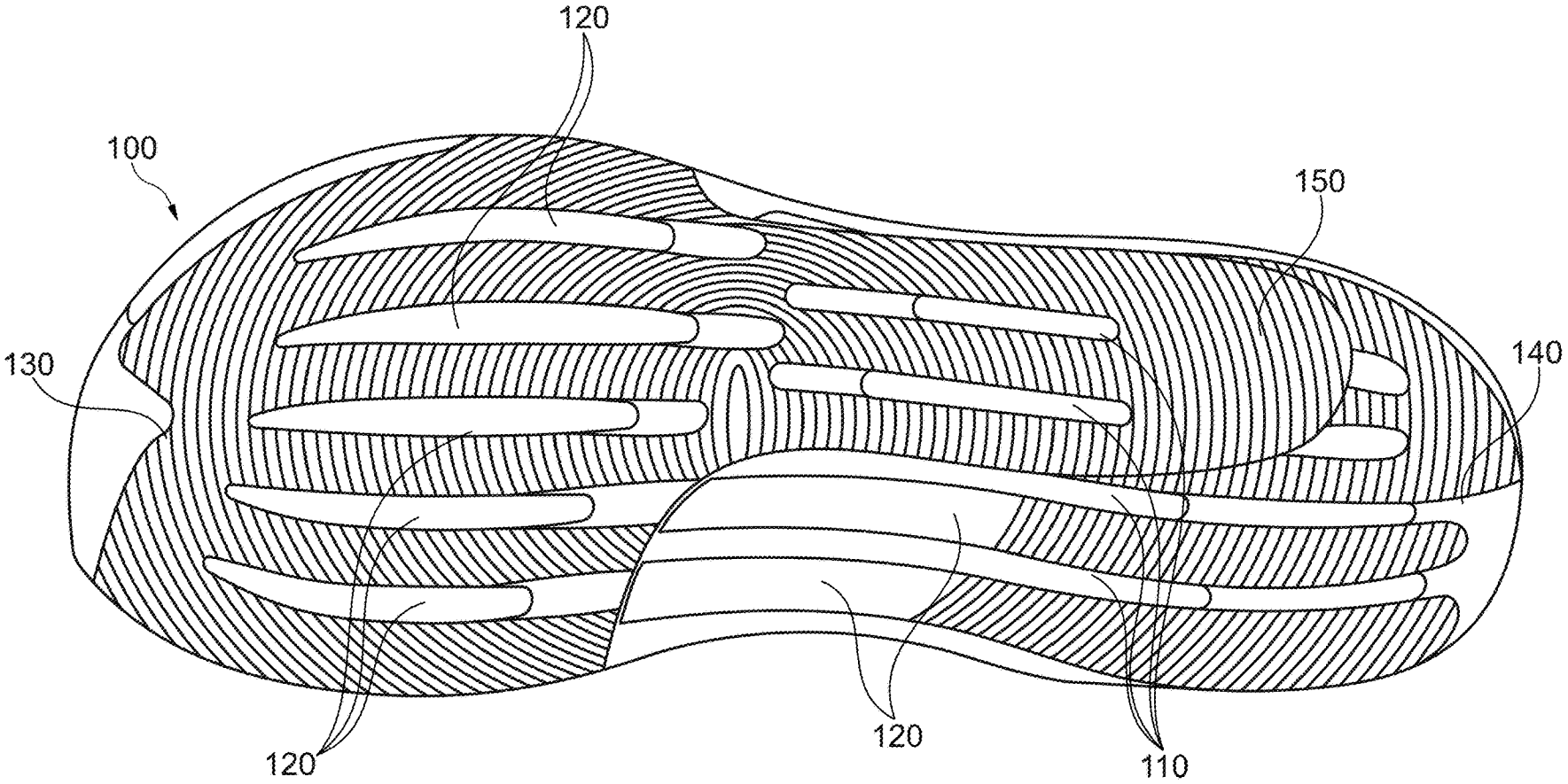
FIG. 1: shows a sole for a shoe, in particular for a sports shoe such as a running shoe, according to embodiments of the present disclosure.

The above-mentioned objects are at least partially achieved by the subject matter of the independent claims. Some embodiments are subject of the dependent claims, and other suitable aspects of the present invention are described through the overall disclosure of the present application. It is noted that the headlines in the present disclosure are provided solely for the purpose to assist in keeping an overview during reading. The headlines do not mean that features of the respective embodiments cannot be combined.

Sole for a Shoe

In one aspect, the objects of the present disclosure are at least partially solved by a sole for a shoe, in particular for a sports shoe such as a running shoe, comprising a midsole and at least one ground-contacting support element comprising a foam material and being distinct from the midsole, wherein the foam material of the at least one ground-contacting support element is stiffer than a midsole material.

In this manner, the traction and durability of the sole are improved by using at least one ground-contacting support element comprising a foam material and being distinct from the midsole. The support element has two main functions, namely supporting the sole by distributing and guiding forces throughout as well as providing the ground contact to avoid material abrasion of the sole. Further, a stiffer foam material in the ground-contacting support element provides increased stability and rigidity to the shoe sole. This helps to minimize excessive pronation or supination of the foot, reducing the risk of ankle injuries and enhancing overall stability during movement. Further, using a ground-contacting foam also allows to reduce the amount of traditional outsole materials like rubber.

The foam material in the ground-contacting support element provides excellent shock-absorbing properties. It effectively disperses the forces generated from ground impact, thereby reducing stress on the feet, joints, and muscles. This helps minimize the risk of injuries such as shin splints or stress fractures. Foam materials used in ground-contacting support elements exhibit high energy return characteristics. This means that they efficiently store and release energy with each foot strike, propelling the wearer forward and enhancing overall running efficiency. This can lead to improved performance and reduced fatigue over long distances. In addition, the ground-contacting support element allows for targeted support and stability where it's needed most. Manufacturers can design the geometry and density of the foam material to provide customized levels of support and stability for different foot types and running styles. Foam materials are lightweight, which helps keep the overall weight of the shoe down. This is particularly advantageous for running shoes, where lighter footwear can improve agility, speed, and overall comfort. The use of foam-based ground-contacting support elements allows for a lighter and more responsive shoe without compromising on cushioning or support. Foam materials offer flexibility and responsiveness, allowing the sole to adapt to the natural movements of the foot during the running gait cycle. This promotes a more natural and efficient stride, reducing the risk of muscle fatigue and discomfort associated with rigid or overly structured footwear. Foam materials used in ground-contacting support elements are often durable and resistant to compression set, meaning they can maintain their cushioning properties over extended periods of use. This ensures that the shoe retains its performance characteristics and provides consistent support and comfort throughout its lifespan.

The distinct design of the ground-contacting support element allows for targeted reinforcement in specific areas of the sole, providing enhanced stability and support where needed. This can also help improve balance and proprioception, reducing the risk of ankle rolling or other injuries. By separating the ground-contacting support element from the midsole, shoe designers can create customized cushioning zones tailored to different areas of the foot. This allows for more precise control over cushioning levels and pressure distribution, resulting in a more comfortable and supportive fit. The distinct construction of the ground-contacting support element can improve the durability and longevity of the shoe sole. The separation of the ground-contacting support element from the midsole allows for optimized weight distribution across the sole of the shoe. This can help reduce fatigue and discomfort during extended wear by ensuring that pressure is evenly distributed across the foot, minimizing hot spots and pressure points. The distinct design of the ground-contacting support element can enhance the flexibility and responsiveness of the sole. By allowing for independent movement of the ground-contacting support element relative to the midsole, the shoe may better adapt to the natural motion of the foot, promoting a more fluid and dynamic gait.

Moreover, having the foam material of the ground-contacting support element stiffer than the midsole material offers technical advantages such as enhanced stability, improved arch support, optimized energy transfer, long-lasting cushioning, reduced fatigue, and customizable support. These benefits contribute to a more comfortable, supportive, and high-performance shoe design. For instance, a stiffer foam material in the ground-contacting support element provides increased stability and rigidity to the shoe sole. This helps to minimize excessive pronation or supination of the foot, reducing the risk of ankle injuries and enhancing overall stability during movement. Moreover, the stiffer foam material offers better support for the arch of the foot, helping to maintain its natural shape and alignment. This can alleviate discomfort and fatigue associated with flat feet or overpronation, providing relief for individuals with arch-related issues. Furthermore, a stiffer foam material efficiently transfers energy from the ground to the foot during each step, promoting a more responsive and efficient gait. This enhances propulsion and forward momentum, particularly important for athletes and active individuals seeking improved performance. While the foam material is stiffer than the midsole material, it still retains sufficient cushioning properties to provide comfort and shock absorption. The stiffness helps prevent excessive compression and breakdown of the material over time, ensuring long-lasting cushioning and support for the wearer. The stiffer foam material reduces the amount of energy expended by the foot muscles to stabilize the arch and maintain balance. This can result in reduced foot fatigue and improved comfort, especially during extended periods of standing or walking. Moreover, the stiffness of the foam material may be tailored to meet the specific support needs of different individuals or activities. By adjusting the foam composition and density, shoe designers can customize the level of support provided by the ground-contacting support element to accommodate various foot types and preferences.

In summary, incorporating a ground-contacting support element comprising foam material separate from the midsole in a shoe sole and being stiffer than the midsole may deliver superior cushioning, shock absorption, energy return, support, stability, lightweight performance, flexibility, and durability. These features combine to enhance the overall running experience and contribute to improved performance, comfort and injury prevention for the wearer.

Materials and Shape

In some embodiments of the sole for shoe as described herein, the at least one ground-contacting support element provides at least 40%, e.g., at least 50%, at least 60%, at least 70%, or at least 80% of a ground-contacting surface of the sole. Since the at least one ground-contacting support element provides a significant percentage of the ground-contacting surface of the sole, the advantages of high traction and high durability as mentioned above as well as superior cushioning, shock absorption, energy return, support, stability, lightweight performance may be provided. For example, by allocating a substantial portion of the ground-contacting surface to the support element, the shoe can provide enhanced stability and support to the wearer. This distribution of surface area helps distribute weight more evenly and reduces pressure points, promoting comfort and balance. In addition, a larger ground-contacting support element can offer greater shock absorption capabilities, cushioning the foot against impacts and reducing the risk of discomfort or injury during activities such as walking, running, or jumping.

In some embodiments of the sole for shoe as described herein, the foam material of the at least one ground-contacting support element comprises at least one of the following materials: ethylene-vinyl-acetate (EVA) or Ethylene Propylene Diene Monomer (EPDM).

For example, foamed EVA provides better cushioning, support, flexibility, and durability for enhanced comfort and performance. EVA foam is lightweight, which helps reduce the overall weight of the shoe. This lightweight nature enhances comfort and reduces fatigue during prolonged wear. Despite its lightweight and flexible nature, EVA foam is also durable and resistant to wear and tear. It can withstand repeated compression and deformation without losing its shape or cushioning properties, ensuring long-lasting performance and comfort.

Moreover, foamed EPDM offers a combination of lightweight, shock absorption, energy return, flexibility, durability, temperature stability, and water resistance. For example, the cellular structure of foamed EPDM provides excellent shock absorption properties, helping to cushion the foot against impacts from walking, running, or jumping. This can reduce the risk of discomfort or injury and improve overall comfort.

In some embodiments of the sole for shoe as described herein, the foam material of the at least one ground-contacting support element comprises a hardness of between 40 and 75 Shore C, e.g., of between 45 and 70 Shore C, approximately 48 Shore C or approximately 60 Shore C or approximately 65 Shore C, wherein the hardness is larger than of the midsole.

The specified Shore Hardness values ensure that the foam material provides an appropriate balance of cushioning and support. A hardness of approximately 48 Shore C offers a softer feel, providing ample cushioning to absorb shock and reduce impact on the foot. In contrast, a hardness of approximately 60 Shore C indicates a slightly firmer foam material, offering increased support and stability, particularly for individuals with higher arches or greater pronation. Moreover, a hardness of approximately 65 Shore C provides a balanced combination of support, durability, responsiveness, and versatility, making it suitable for a wide range of activities and ensuring consistent performance over time.

Further, by offering foam materials with different shore hardness values, shoe designers can provide customizable comfort options to accommodate the preferences and needs of different individuals. Some wearers may prefer a softer, more cushioned feel underfoot, while others may prefer a firmer, more supportive sensation. The ability to select foam materials with varying hardness values allows for tailored comfort solutions.

In addition, foam materials with higher hardness values tend to be more resilient and resistant to compression, deformation, and wear over time. This results in a shoe sole that maintains its cushioning and support properties for longer periods, providing durable comfort and performance throughout the lifespan of the footwear.

Further, foam materials with standardized hardness values undergo rigorous testing and quality control measures to ensure consistent performance and reliability. This results in shoe soles that deliver consistent cushioning, support, and comfort characteristics across different production batches, maintaining wearer satisfaction and brand reputation.

In some embodiments of the sole for shoe as described herein, the midsole material comprises a foam material. When both the midsole and ground-contacting support element comprise foam material, it offers several technical advantages. For instance, uniform cushioning is provided with consistent comfort throughout the entire sole. The seamless transition of having only foam materials also ensures a smooth and natural feel underfoot. Maximizing impact force attenuation is provided reducing the risk of injuries and thus enhanced shock absorption. Overall, it results in a sole that is comfortable, responsive, and suitable for various activities and wearers.

In some embodiments of the sole for shoe as described herein, the midsole material comprises at least one of the following materials: a particle foam such as comprising at least one of the following materials: expanded thermoplastic polyurethane (eTPU), expanded polyamide (ePA), expanded polyether-block-amide (ePEBA), expanded thermoplastic polyester ether elastomer (eTPEE), expanded polylactide (ePLA), expanded polyethylene terephthalate (ePET), expanded polybutylene terephthalate (ePBT), and expanded thermoplastic olefin (eTPO): a block foam such as comprising at least one of the following materials: thermoplastic polyurethane (TPU), polyamide (PA), polyether-block-amide (PEBA), thermoplastic polyester ether elastomer (TPEE), polylactide (PLA), polyethylene terephthalate (PET), polybutylene terephthalate (PBT), and thermoplastic olefin (TPO), ethylene-vinyl-acetate (EVA).

In some embodiments of the sole for shoe as described herein, the at least one ground-contacting support element comprises a material with reinforcement, such as a material with fibers. Incorporating reinforcement into the foamed material of the ground-contacting support element offers numerous technical advantages, including enhanced structural integrity, durability, weight distribution, shock absorption, and design flexibility.

For example, fibers embedded within the material provide reinforcement, increasing the overall strength and durability of the support element. This helps the shoe withstand wear and tear, extending its lifespan.

Further, the presence of fibers adds structural integrity to the support element, enhancing its ability to maintain shape and provide stable support to the foot. This can reduce the risk of ankle rolling or other injuries, especially during dynamic movements.

Depending on the type and arrangement of fibers used, the flexibility of the ground-contacting support element may be customized to suit the needs of the wearer. This allows for targeted flexibility in specific areas of the sole, providing optimal comfort and performance.

Certain types of fibers, such as carbon or glass fibers, have inherent stiffness properties that can contribute to improved energy return. As the fibers flex and rebound with each step, they efficiently transfer energy back to the wearer, promoting a more responsive gait Moreover, some fiber materials have moisture-wicking properties, helping to draw sweat away from the foot and maintain a dry and comfortable environment inside the shoe. This can reduce the risk of blisters and discomfort during prolonged wear.

Despite their added strength and reinforcement, many fiber materials are lightweight, contributing to overall shoe weight reduction. This enhances agility and comfort for the wearer, especially during activities that require quick and agile movements.

Overall, having the ground-contacting support element comprise a material with reinforcement such as fibers provides technical advantages such as enhanced strength, durability, stability, support, flexibility, energy return, moisture management, lightweight construction, and customizable design options. These benefits contribute to a shoe sole that is comfortable, supportive, and high-performing across various activities and wearers.

In some embodiments of the sole for shoe as described herein, the at least one ground-contacting support element is rod-shaped. This specific shape offers technical advantages such as enhanced stability, targeted support, improved energy transfer, customizable flexibility, optimized weight distribution and increased durability. "Rod-shaped" refers to objects or structures that have a long, cylindrical shape resembling that of a rod or cylinder. In other words, they are elongated and relatively narrow, with a straight or slightly curved form.

For instance, the rod-shaped design provides inherent stability to the shoe sole, minimizing the risk of tilting or rolling during movement. This enhances balance and reduces the likelihood of ankle injuries.

Moreover, the elongated form of the rod-shaped support element allows for targeted support in specific areas of the foot, such as the arch or heel. This helps distribute pressure evenly and reduces strain on individual pressure points, enhancing overall comfort.

The rod-shaped design facilitates efficient energy transfer from the ground to the foot with each step. This promotes a more responsive and efficient gait, enhancing overall propulsion and reducing fatigue.

Further, depending on the material and construction, rod-shaped support elements may be designed to provide varying levels of flexibility. This allows for customization based on wearer preferences and activity requirements.

The elongated shape of the rod-shaped support element helps distribute weight more evenly across the sole of the shoe. This minimizes pressure points and reduces discomfort, especially during prolonged wear.

The rod-shaped design also offers structural integrity and resilience, resulting in increased durability and longevity of the shoe sole. This ensures that the support element maintains its shape and performance over time, even with repeated use.

Although the rod-shaped ground-contacting support elements may be used, it will be clear to the skilled person that other geometric shapes having an elongated and narrow shape may be used within the scope of the present invention to achieve the same technical effects. For example, in some embodiments, plate-like shaped, cylindrical-shaped, or tubular-shaped being elongated and narrow may be used.

In some embodiments of the sole for shoe as described herein, the at least one ground-contacting support element is formed by at least one of the following manufacturing processes: injection molding or compression molding. These processes offer precision, consistency, design flexibility, production efficiency, tailored material properties, and seamless integration.

For example, injection molding and compression molding processes allow for the precise and consistent formation of complex shapes, including intricate patterns and details in the ground-contacting support element. This ensures uniformity in the sole's design, leading to consistent performance and comfort for the wearer.

Further, the molding processes enable efficient material distribution within the ground-contacting support element, ensuring that the foamed material is distributed evenly and without voids or defects. This results in a structurally sound and reliable support element that provides consistent cushioning and support across the entire sole.

Moreover, both injection molding and compression molding are highly efficient manufacturing processes that can produce large quantities of shoe soles with minimal waste. This allows for cost-effective production of soles with foamed support elements, making them more accessible to manufacturers and consumers alike.

In embodiments of the sole for shoe as described herein, the at least one ground-contacting support element is glued onto the midsole.

In this way, enhanced stability, durability, aesthetics, weight reduction, comfort, flexibility, and manufacturing efficiency in shoe construction may be provided. For instance, gluing the ground-contacting support element onto the midsole ensures a secure and stable attachment. This helps prevent shifting or displacement of the support element during movement, maintaining consistent support and alignment for the wearer's foot. Moreover, the bonding provided by the adhesive enhances the overall durability of the shoe construction. It helps reinforce the connection between the ground-contacting support element and the midsole, reducing the likelihood of separation or detachment over time, even under heavy usage or stress.

In some embodiments of the sole for shoe as described herein, a width of the at least one ground-contacting support element varies along said at least one ground-contacting support element. Varying the width of the ground-contacting support element along its length offers technical advantages such as customized support, optimized weight distribution, improved flexibility, enhanced propulsion, dynamic cushioning, and targeted relief. These benefits contribute to a shoe that is comfortable, supportive, and performance-driven, suitable for a wide range of activities and wearers.

For instance, designers can tailor the level of support provided to different areas of the foot. For example, a larger width in the heel region can offer enhanced cushioning and shock absorption, while a smaller width in the arch area can provide targeted support and stability.

Moreover, the variation in width helps distribute the wearer's weight more evenly across the sole of the shoe. This reduces pressure points and discomfort, particularly in areas that experience higher loads during movement.

Location and Extension

In some embodiments of the sole for shoe as described herein, the at least one ground-contacting support element is rod shaped and extends substantially parallel to the longitudinal extension direction of the sole.

The technical advantage of this embodiment lies in their ability to provide enhanced stability, weight distribution, propulsion, customizable support, durability, and aesthetic appeal, resulting in improved comfort, performance, and longevity for the wearer.

A rod-shaped support element provides longitudinal reinforcement along the length of the sole, contributing to increased stability and support for the wearer. This configuration helps prevent excessive torsional or lateral movement of the foot, reducing the risk of ankle sprains or other injuries, especially during dynamic activities.

The longitudinal extension of the rod-shaped support element facilitates efficient energy transfer during each step, promoting a more powerful and fluid gait. This can lead to improved propulsion and overall performance, particularly in athletic footwear designed for running or other high-intensity activities.

In this way, the rod-shaped support element may be strategically positioned and sized to provide targeted support and cushioning where it's needed most. Manufacturers can adjust the length, width, and placement of the support elements to accommodate different foot shapes, arch types, and biomechanical needs, resulting in a more personalized and comfortable fit for the wearer.

In some embodiments of the sole for shoe as described herein, the at least one ground-contacting support element has a length of at least 15 cm, e.g., of at least 21 cm, and/or a width of at least 5 mm, e.g., of at least 9 mm. The length may also be in the range of 15 cm to 32 cm, e.g., between 19 cm and 29 cm, between 19 cm and 26 cm, or between 25 cm and 29 cm. The width may also be in the range of 5 mm to 12 mm, e.g., between 5 mm and 11 mm, or between 9 mm and 12 mm. These numbers were found to provide enhanced properties as explained above.

In some embodiments of the sole for shoe as described herein, the at least one ground-contacting support element is not inserted in the midsole.

By being separate from the midsole, the ground-contacting support element can provide more targeted stability and support to specific areas of the sole. This allows for better customization of support based on the wearer's foot biomechanics and preferences, potentially reducing the risk of injuries such as overpronation or supination.

Ground-contacting support elements that are not inserted in the midsole may have their own independent cushioning properties, allowing them to effectively absorb shock and impact forces from the ground. This can help reduce stress on the joints and muscles, enhancing overall comfort and reducing the risk of fatigue during prolonged activities.

Separating the ground-contacting support element from the midsole can increase the durability of both components. The support element may be made from more durable materials that are better able to withstand wear and tear, while the midsole can retain its cushioning properties without being subjected to the same level of compression and deformation.

Without being constrained by the midsole, designers have more flexibility to experiment with different shapes, sizes, and materials for the ground-contacting support element. This allows for greater innovation in sole design, potentially leading to improved performance, comfort, and aesthetics in footwear.

The absence of a support element inserted in the midsole allows for a more customizable fit for the wearer. Different types of support elements may be incorporated into the sole design based on factors such as foot shape, arch height, and pronation, providing a personalized fit that enhances comfort and performance.

In some embodiments of the sole for shoe as described herein, the at least one ground-contacting support element is at least partly inserted in the midsole. Moreover, the midsole may have at least one recess for receiving the at least one ground-contacting support element partially therein, such that the at least one ground-contacting support element protrudes from a surface of the midsole.

The technical advantage of integrating ground-contacting support elements within the midsole, utilizing recesses for precise positioning, offers improved stability, energy transfer, comfort, customization, aesthetics, and durability in footwear design.

By embedding the ground-contacting support elements within the midsole, the shoe achieves improved stability and support for the wearer. This integration ensures that the support elements are securely positioned and aligned with the foot's natural contours, enhancing overall comfort and reducing the risk of instability or pronation.

Placing the ground-contacting support elements within the midsole facilitates more efficient energy transfer during each step. The direct integration with the midsole allows for seamless transmission of forces between the foot and the ground, promoting a smoother and more responsive gait.

Further, the embedded support elements help absorb and distribute impact forces evenly across the sole, reducing the strain on the feet and lower extremities. This helps minimize fatigue and discomfort during prolonged periods of standing, walking, or running, improving overall comfort and performance.

Moreover, the recesses in the midsole provide a means for precisely positioning the ground-contacting support elements according to the wearer's specific support and cushioning needs. Manufacturers can adjust the depth and location of the recesses to tailor the level of support and responsiveness in different regions of the sole, accommodating variations in foot anatomy and biomechanics.

In some embodiments of the sole for shoe as described herein, the at least one ground-contacting support element protrudes at least 3 mm, e.g., at least 3.5 mm, from the midsole.

In some embodiments of the sole for shoe as described herein, the at least one ground-contacting support element is designed to allow at least one of the following functions: increase the traction of the sole, increase durability of the sole, increased wearing comfort, increased support of the sole, reduced weight of the sole, increased cushioning, increased energy return.

The design of the ground-contacting support element can incorporate features such as tread patterns, grooves, or protrusions that enhance traction on different surfaces, improving grip and stability during walking, running, or other activities.

Moreover, the ground-contacting support element can increase the overall durability of the shoe by strategically reinforcing high-wear areas of the sole, prolonging its lifespan and reducing the need for frequent replacements.

Further, the design of the support element can incorporate features such as cushioning pads, arch supports, or shock-absorbing materials to enhance wearing comfort, reducing fatigue and discomfort during extended wear periods.

Moreover, the support element may be engineered to provide targeted support to specific areas of the foot, such as the arch or heel, improving overall foot stability and reducing the risk of injuries or strain.

The ground-contacting support element can help reduce the overall weight of the sole by utilizing lightweight materials and innovative design techniques, making the shoe more comfortable to wear and improving agility and responsiveness during movement.

Incorporating cushioning properties into the support element can improve shock absorption and impact protection, reducing stress on the feet and joints and enhancing overall comfort, particularly during high-impact activities.

Moreover, the design of the support element can optimize energy transfer properties, enabling the sole to efficiently convert mechanical energy from foot strike into propulsion during each step, improving overall energy return and performance.

In some embodiments of the sole for shoe as described herein, the at least one ground-contacting support element has a shape comprising a localized low point relative to a horizontal plane, and wherein the at least one ground-contacting support element extends in the forefoot region of the sole.

The term "horizontal plane" is used to designate a plane parallel to a flat piece of ground in the state when the sole sits on this flat piece of ground and is not bent or twisted, i.e., in a force-free state.

"Localized" means that the low point is not an extended region but an identifiable point. In other words, on both sides of the low point, the ground-contacting support element move upwardly.

To further promote the previous effects, the at least one ground-contacting support element may curve in a smooth and continuous manner throughout the front half of the foot, e.g., its geometry (as, e.g., defined by their flow-lines) may follow at least approximately an arc of a circle (possibly with different arcs/circles for different ground-contacting support elements). This may allow a very smooth roll-off or stride during running, from heel to toe, namely a rolling movement, because a circle is a very efficient shape for movement and hence provides a very efficient movement path, as it rolls effortlessly.

In some embodiments of the sole for shoe as described herein, the at least one ground-contacting support element extends into the forefoot region of the sole.

Extending the support element into the forefoot region provides additional stability and support to the front of the foot, where the majority of propulsion and weight-bearing activities occur during walking, running, or jumping. This helps improve balance, reduces the risk of ankle rolling, and enhances overall foot control and responsiveness.

Further, by extending into the forefoot region, the support element facilitates more efficient energy transfer from the ground to the foot during each step. This enhances propulsion and forward momentum, allowing for a more powerful and efficient gait cycle, especially during activities that require quick accelerations or changes in direction.

Moreover, during the toe-off phase of the gait cycle, the extended support element helps provide a stable platform for propulsion, facilitating a more efficient push-off and reducing energy loss. This results in improved speed, agility, and overall performance, particularly in athletic footwear designed for running or other dynamic activities.

In some embodiments of the sole for shoe as described herein, the at least one ground-contacting support element further extends rearwardly into the midfoot region of the sole.

Extending the support element into the midfoot region provides enhanced stability and support to the central part of the foot. This helps maintain proper alignment and reduces the risk of excessive pronation or supination, enhancing overall balance and reducing the likelihood of ankle or arch-related injuries.

Moreover, the support element in the midfoot region helps provide targeted support to the arch of the foot, which is crucial for maintaining its natural shape and function. This may be particularly beneficial for individuals with flat feet or high arches, as it helps distribute pressure more evenly across the foot and reduces strain on the plantar fascia.

Also, by extending into the midfoot region, the support element facilitates efficient energy transfer from the ground to the foot during each step. This enhances propulsion and forward momentum, leading to a more efficient and powerful gait cycle, especially during activities that require sustained periods of walking or running.

In some embodiments of the sole for shoe as described herein, the at least one ground-contacting support element further extends rearwardly and into the heel region of the sole.

Extending the support element into the heel region enhances stability and shock absorption during heel strike, which is a critical phase of the gait cycle. The support element helps distribute impact forces more evenly across the sole, reducing stress on the heel and lower extremities and minimizing the risk of injuries such as heel pain or plantar fasciitis.

The presence of the support element in the heel region provides additional cushioning and comfort, particularly for activities that involve repetitive heel impacts, such as walking or running. This helps attenuate shock and vibration, reducing fatigue and discomfort and improving overall comfort during prolonged wear.

Also, the presence of the support element in the heel region helps alleviate pressure and reduce pain associated with conditions such as heel spurs, Achilles tendonitis, or fat pad atrophy. The cushioning and support provided by the support element help cushion the heel and minimize friction, promoting a more comfortable and pain-free wearing experience.

In some embodiments of the sole for shoe as described herein, the at least one ground-contacting further extends into the medial and/or lateral region of the sole.

By extending into the medial and/or lateral regions of the sole, the support element provides increased stability and balance to the wearer. This helps prevent excessive inward (pronation) or outward (supination) rolling of the foot, reducing the risk of ankle injuries, and improving overall foot control.

Further, the extended support element helps promote proper alignment of the foot and lower limb by providing support to the medial and lateral arches. This can help alleviate issues related to overpronation or oversupination, such as plantar fasciitis or IT band syndrome, and improve overall posture and biomechanics.

Also, the additional support provided by the extended support element helps distribute forces more evenly across the foot, reducing the strain on specific muscles, tendons, and ligaments. This can help decrease the risk of overuse injuries, such as stress fractures, tendonitis, or shin splints, particularly during repetitive or high-impact activities.

In some embodiments of the sole for shoe as described herein, the sole comprises at least two, e.g., at least three support elements. Each support element may be rod-shaped.

Further, by utilizing multiple support elements, the sole can more effectively distribute the wearer's weight across a larger surface area. This helps to alleviate pressure points and reduce discomfort, particularly during prolonged periods of standing or walking.

Each rod-shaped support element may be strategically positioned to provide targeted support to different areas of the foot, including the arch. This allows for customized arch support tailored to the individual's foot anatomy and biomechanical needs, promoting proper alignment, and reducing strain on the arches.

The rigid nature of rod-shaped support elements facilitates efficient energy transfer during each step, promoting a more powerful and responsive gait. This can lead to improved propulsion and overall performance, particularly in athletic footwear designed for running or other high-intensity activities.

In some embodiments of the sole for shoe as described herein, wherein the at least two, e.g., at least three ground-contacting support elements are tapered.

Tapered support elements help distribute weight more evenly across the sole of the shoe. By gradually reducing in thickness or width towards the ends, they minimize pressure points and reduce the likelihood of discomfort or fatigue, especially during prolonged periods of standing or walking.

Further, the tapering design of the support elements provides a broader base of support, enhancing stability and balance for the wearer. This is particularly beneficial during dynamic movements such as running or jumping, where maintaining proper alignment and control is essential to prevent injuries.

Tapered support elements also offer a balance between rigidity and flexibility, allowing for natural foot movement while still providing sufficient support. The gradual reduction in thickness or width towards the ends allows the sole to flex more freely, promoting a more natural and efficient gait cycle.

Tapered support elements may be designed to provide targeted support and cushioning in specific areas of the sole. Manufacturers can adjust the degree of tapering and the distribution of material to accommodate different foot shapes, arch types, and biomechanical needs, ensuring a personalized fit and enhanced comfort for the wearer.

In some embodiments of the sole for shoe as described herein, there are exactly five ground-contacting support elements, each corresponding to a respective metatarsal bone.

By aligning each support element with a specific metatarsal bone, the sole provides targeted support and cushioning to the natural contours of the foot. This helps distribute pressure evenly across the forefoot, reducing the risk of discomfort, fatigue, and injuries such as metatarsalgia or Morton's neuroma.

Further, having five ground-contacting support elements provides a stable foundation for the foot, improving balance and proprioception during walking, running, or other weight-bearing activities. This reduces the risk of ankle rolling or instability, especially during dynamic movements or changes in direction.

The alignment of the support elements with the metatarsal bones facilitates more efficient energy transfer during the toe-off phase of the gait cycle. This promotes a more powerful push-off and enhances forward propulsion, improving speed, agility, and overall performance, particularly in athletic footwear designed for running or jumping. Shoe In a further aspect of the present disclosure, the objects are at least partially solved by a shoe, in particular a running shoe, comprising a sole as described in any one of the embodiments in here.

Since the shoe of this aspect comprises the sole as described elsewhere, it is understood that the technical properties shown or described for the sole, the advantages and the improvements over the state of the art are likewise applicable to the shoe with and vice versa.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following only some possible embodiments of the invention are described in detail. However, the present invention is not limited to these, and a multitude of other embodiments are applicable without departing from the scope of the invention. The presented embodiments may be modified in several ways and combined with each other whenever compatible and certain features may be omitted in so far as they appear dispensable. In particular, the disclosed embodiments may be modified by combining certain features of one embodiment with at least one feature of another embodiment.

It is to be understood that not all features of the described aspects/embodiments must be present for realizing the technical advantages provided by the present disclosure, which is defined by the subject matter of the claims. The disclosed aspects/embodiments may be modified by combining certain features of one aspect/embodiment with at least one feature of another aspect/embodiment. Specifically, the skilled person will understand that features, and/or functional elements of one aspect/embodiment may be combined with technically compatible features, and/or functional elements of any other aspect/embodiment of the present disclosure given that the resulting combination falls within the definition of the present disclosure.

While the embodiments below are described primarily with reference to a sole for a shoe, in particular for a sports shoe such as a running shoe, the skilled person will recognize that the disclosure according to the invention can equally be applied in a plurality of different technical fields and/or use cases. For instance, in some embodiments, other sports shoe may be for basketball, soccer, football, tennis, golf, cross-training, hiking, cycling, trailrunning or snowboarding. The expression "sports shoe such as a running shoe" means that athletic sports shoes are mentioned without use cases not directed to the athletic use like business shoes or chess shoes or house slippers.

Throughout the present figures and specification, the same reference numerals refer to the same elements. For the sake of clarity and conciseness, certain features, parts, elements, aspects, components and/or steps of certain embodiments are presented without undue detail where such detail would be apparent to the skilled person in the art considering the teachings herein and/or where such detail would obfuscate an understanding of more pertinent aspects of the embodiments.

As understood by the skilled person and/or to avoid redundancies, reference is also made to the explanations in the preceding sections, which also apply to the following detailed description. Further, not all features, parts, elements, aspects, components and/or steps are expressly indicated by reference signs for the sake of brevity and clarity. This particularly applies, where the skilled person recognizes that such features, parts, elements, aspects, components and/or steps are present in a plurality.

Definitions

The term "ground-contacting surface" for a sole as used herein may refer to the portion of a sole that makes direct contact with the ground during weight-bearing activities such as walking, running, or standing. It encompasses the external surface area of the sole that encounters the ground, providing traction, stability, and support to the wearer.

The term "rod-shaped" for elements of a sole as used herein may refer to structural components or supports within the sole that exhibit a long and slender like cylindrical shape, resembling a rod or cylinder. These elements are typically elongated along their longitudinal axis and may vary in width and length depending on the design and intended function of the shoe. They have a continuous surface.

The term "forefoot region" of a sole as used herein may refer to the front part of the sole, e.g., the forefoot part of the sole, encompassing the area from the ball of the foot to the toes. It is the part of the sole that encounters the ground during propulsion and toe-off phases of the gait cycle.

The term "midfoot region" of a sole as used herein may refer to the central portion of the sole that encompasses the area between the ball of the foot (forefoot) and the heel. It is located approximately in the middle of the foot's longitudinal axis.

The term "heel region" of a sole as used herein may refer to the back part of the sole, e.g., the rear part of the sole, which is usually in proximity to the heel of the foot of the wearer, when worn during ordinary use. In said heel region of the sole, an anterior end of a foot of the wearer may be received. In particular, the "calcaneal region" of a foot of a wearer may be received. The calcaneus is a large bone that makes up the heel of the foot.

The term "medial" of a sole as used herein may refer to an inner side of the sole. This inner side may be closer to a centerline of the body of the wearer, when the shoe comprising the sole is worn, compared to a lateral side. This inner side may extend from a toe region to a heel region. This inner side may comprise substantially about half of the part of the sole that is arranged medially as seen from a heel to toe midline of the sole. Said heel to toe midline may be passing along the heel to toe axis of the sole.

The term "lateral" of a sole as used herein may refer to an outer side of the sole. This outer side may be farther way from a centerline of the body of the wearer, when the shoe comprising the sole is worn, compared to a medial side. This outer side may extend from a toe region to a heel region. This outer side may comprise substantially about half of the part of the sole that is arranged laterally as seen from a heel to toe midline. Said heel to toe midline may be passing along the heel to toe axis of the sole.

Unless otherwise stated, the term "substantially" as used in the present context may be understood to a great or significant extent or for the most part or essentially. In particular, manufacturing tolerances are included by this term. Hence, any values or arrangements described by using the term "substantially" may slightly deviate from the described values or arrangements.

The term "and/or" is only an association relationship describing associated objects and represents that three relationships may exist. For example, A and/or B may represent three conditions: i.e., independent existence of A, existence of both A and B and independent existence of B. In addition, the character "/" in the disclosure usually represents that previous and next associated objects form an "or" relationship.

The terms "upper", "above", "below", "under" and the like as used in the present invention to indicate a relative position in space are used for the purpose of facilitating explanation to describe a sole, a shoe, an element, a part, an object and/or a feature shown in the drawings relative to the relationship of another shoe, element, part, object and/or feature.

DESCRIPTION OF FIGURES

FIG. 1 shows a bottom view of a sole 100 for a shoe, in particular for a sports shoe such as a running shoe, according to embodiments of the present disclosure.

The sole 100 comprises a midsole 110 (partially visible as white regions) and at least one ground-contacting support element 120 comprising a foam material and being distinct from the midsole 110, wherein the at least one ground-contacting support element 120 is stiffer than a midsole material. The at least one ground-contacting support element 120 provides at least 40% of a ground-contacting surface of the sole 100 (parts of the light blue regions). The white regions of the midsole 110 between the light blue regions of the at least one ground-contacting support element 120 do not refer to the "ground-contacting surface" as used herein.

In some embodiments, the embodiment of FIG. 1 and also for all other embodiments in the disclosure that the at least one ground-contacting support element provides at least 50%, e.g., at least 60%, at least 70%, or at least 80% of a ground-contacting surface of the sole 100 (parts of the light blue regions).

Measuring the stiffness of the foam material typically involves conducting mechanical tests to evaluate its response to applied forces. Common methods used to measure the stiffness of foam materials could be compression testing, indentation hardness tests, such as Shore hardness tests, flexural testing or bending testing as well as dynamic mechanical analysis (DMA), tensile testing or creep testing.

The foam material of the at least one ground-contacting support element 120 comprises a hardness of between 40 and 75 Shore C, approximately 60 Shore C. In some embodiments, other materials may have other hardness values as described.

The midsole 100 may comprise a foam material. The foam material may be a block (homogeneous) foam material. Examples of such materials are ethylene-vinyl-acetate (EVA), injection-molded thermoplastic polyurethane (TPU), thermoplastic polyester ether elastomer (TPEE) or other suitable materials. Such materials may be used because they are cheaper and/or easier to process in certain regards than particle foams. For example, with injection molding where a liquid material is injected into a molding cavity under high pressure, it may be easier to obtain an even distribution of the midsole material around the reinforcing members than using a particulate base material which might get stuck.

The midsole may comprise particles from a particle foam. Suitable materials for the particle foam that comprises particles may be at least one of the following materials: expanded thermoplastic polyurethane (eTPU), expanded polyamide (ePA), expanded polyether-block-amide (ePEBA), expanded thermoplastic polyester ether elastomer (eTPEE).

These materials are particularly suited for performance footwear like running shoes, as they have a comparatively low weight, a high life span, good temperature stability (i.e., they keep their cushioning and energy returning properties over a large temperature range) and high cushioning and energy return to the runner. Particularly regarding the option of using an ePEBA particle foam, a specific advantage of such a particle foam is that it allows to achieve similar performance level of other particle foams for a lower weight.

Alternatively, or in addition, the following materials can also be used, individually or in combination, for the particles of the particle foam midsole: expanded polylactide (ePLA), expanded polyethylene terephthalate (ePET), expanded polybutylene terephthalate (ePBT), and expanded thermoplastic olefin (eTPO).

The midsole material may comprise at least one of the following materials: a particle foam such as comprising at least one of the following materials: expanded thermoplastic polyurethane (eTPU), expanded polyamide (ePA), expanded polyether-block-amide (ePEBA), expanded thermoplastic polyester ether elastomer (eTPEE), expanded polylactide (ePLA), expanded polyethylene terephthalate (ePET), expanded polybutylene terephthalate (ePBT), and expanded thermoplastic olefin (eTPO); a block foam such as comprising at least one of the following materials: thermoplastic polyurethane (TPU), polyamide (PA), polyether-block-amide (PEBA), thermoplastic polyester ether elastomer (TPEE), polylactide (PLA), polyethylene terephthalate (PET), poly butylene terephthalate (PBT), and thermoplastic olefin (TPO), ethylene-vinyl-acetate (EVA).

It should be noted that particle foams and homogeneous foam materials may also be combined in the midsole 110, and, in particular, different materials may be used in different places and/or layers in the midsole 110, to provide different properties to the respective regions/layers.

The sole 100 further comprises at least one ground-contacting support element 120 comprising a foam material and being distinct from the midsole 110.

In FIG. 1, there are five ground-contacting support elements that are rod-shaped, each corresponding to a respective metatarsal bone. These rod-shaped elements may be formed by compression molding.

In some embodiments, the at least one ground-contacting support element may be plate-like shaped. This offers technical advantages such as enhanced stability, even weight distribution, improved shock absorption, supportive arch structure, and durability. "Plate-like shaped" refers to objects or structures that have a flat, thin, and generally rectangular or oval shape resembling that of a plate. This term is used to describe various objects or formations that exhibit a broad, flat morphology similar to a plate.

For instance, the plate-like shape provides a broad and stable base for the foot, improving overall stability and balance. This reduces the risk of ankle rolling or twisting during movement, especially on uneven terrain.

The broad surface area of the plate-like ground-contacting support element also helps distribute the wearer's weight more evenly across the sole of the shoe. This minimizes pressure points and reduces discomfort, particularly during prolonged periods of standing or walking.

The flat, flexible nature of the plate-like ground-contacting support element allows it to absorb and dissipate impact forces more effectively. This helps cushion the foot against hard surfaces and reduces the risk of injury from repetitive impacts, such as stress fractures or shin splints.

Moreover, a plate-like ground-contacting support element may be designed with a contoured shape to provide additional support to the arch of the foot. This helps maintain proper alignment and reduces strain on the arch muscles and ligaments, promoting overall foot health and comfort.

Plate-like ground-contacting support elements are often constructed from durable materials that withstand repeated use and wear. This ensures that the shoe sole maintains its structural integrity and supportiveness over time, providing long-lasting comfort and performance.

The five rod-shaped ground-contacting support elements 120 extend substantially parallel to the longitudinal extension direction of the sole 100, namely extending from the forefoot region of the sole 100 rearwardly into the midfoot and heel regions of the sole 100. Some of them also extend into the medial and/or lateral region of the sole 100.

The five ground-contacting support elements 120 are tapered. This means that they extend to each other in the toe region and the heel region of the sole. Parts of these connecting regions 130 and 140 being ground-contacting are also part of the at least one ground-contacting support elements 120.

The five ground-contacting support elements 120 have a length of at least 15 cm, namely from 19 cm to 25.1 cm. They also have a width of at least 9 mm, namely from 9.72 mm to 11.5 mm.

The five ground-contacting support elements 120 also protrudes at least 3.5 mm from the midsole 110.

The sole 100 also comprises an additional cover element 150 covering partly the ground-contacting support elements 120. In this additional cover element 150, there are five elongated, slip-shaped openings such that the five ground-contacting support elements 120 penetrates the additional cover element 150 and partly contacting the ground surface when the sole is in use.

Figure 2:
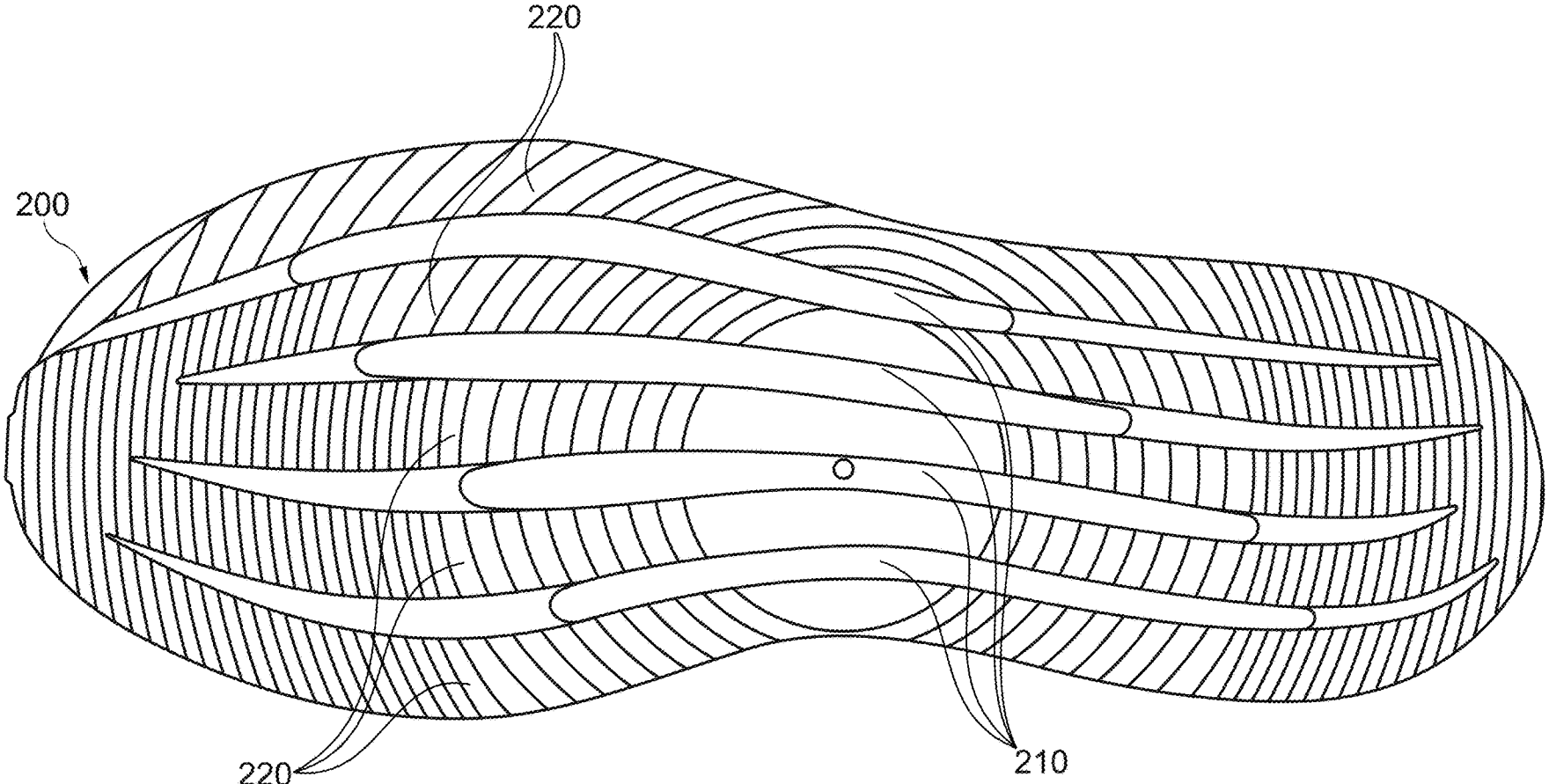
FIG. 2: shows a sole for a shoe, in particular for a sports shoe such as a running shoe, according to embodiments of the present disclosure.

FIG. 2 shows a bottom view of sole 200 for a shoe, in particular for a sports shoe such as a running shoe, according to another embodiment of the present disclosure.

At least one of the features of sole 100 are also included in sole 200.

The sole 200 comprises a midsole 210 (partially visible as white regions) and at least one ground-contacting support element 220, namely five, comprising a foam material and being distinct from the midsole 220, wherein the at least one ground-contacting support element 320 provides at least 50% of a ground-contacting surface of the sole 200. In particular, the five ground-contacting support elements provides at least 60%, at least 70%, at least 80% of a ground-contacting surface of the sole 200, namely essentially the complete ground-contacting surface of the sole 200. As mentioned before, the regions of the midsole 210 between the regions of the at least one ground-contacting support element 220 do not refer to the "ground-contacting surface" as used herein.

The foam material of the at least one ground-contacting support element 220 comprises a hardness of between 40 and 75 Shore C, approximately 48 Shore C. In some embodiments, other materials may be used with other hardness values as described before.

Materials for the midsole 210 and/or the at least one ground-contacting support element 220 may include at least one material described before.

The embodiment of FIG. 2 provides a softer feeling underneath, without compromising the overall energy return of the shoe. This helps to reduce the weight by eliminate the outsole rubber geometry, but the high level of traction is as well maintained.

The five ground-contacting support elements 220 are rod-shaped, each corresponding to a respective metatarsal bone. These rod-shaped elements may be formed by injection molding. This provides higher durability and traction.

The five rod-shaped ground-contacting support elements 220 extend substantially parallel to the longitudinal extension direction of the sole 100, namely extending from the forefoot region of the sole 200 rearwardly into the midfoot and heel regions of the sole 200. Some of them also extend into the medial and/or lateral region of the sole 200.

The five ground-contacting support elements 220 are tapered. This means that they extend to each other in the toe region and the heel region of the sole. Parts of these connecting regions 230 and 240 being ground-contacting are also part of the at least one ground-contacting support elements 220.

The five ground-contacting support elements 220 have a length of at least 21 cm, namely from 25.9 cm to 28.1 cm. They also have a width of at least 5 mm, namely from 5.8 mm to 10.46 mm.

The five ground-contacting support elements 220 also protrudes at least 3.5 mm from the midsole 210.

Compared to the embodiment of FIG. 1, no additional cover element covering partly the ground-contacting support elements 220 is provided in the embodiment of FIG. 2.

EMBODIMENTS

In the following, further examples are described to facilitate the understanding of the invention:

Embodiment 1: A sole (100) for a shoe, in particular for a sports shoe such as a running shoe, comprising: (a.) a midsole (110); and (b.) at least one ground-contacting support element (120) comprising a foam material and being distinct from the midsole; (c.) wherein the foam material of the at least one ground-contacting support element is stiffer than a midsole material.

Embodiment 2: The sole of the preceding Embodiment, wherein the at least one ground-contacting support element provides at least 40%, at least 50%, at least 60%, at least 70%, or at least 80% of a ground-contacting surface of the sole.

Embodiment 3: The sole of one of the preceding Embodiments, wherein the foam material of the at least one ground-contacting support element comprises at least one of the following materials: ethylene-vinyl-acetate, EVA, or Ethylene Propylene Diene Monomer, EPDM.

Embodiment 4: The sole of one of the preceding Embodiments, wherein the foam material of the at least one ground-contacting support element comprises a hardness of between 40 and 75 Shore C, e.g., of between 45 and 70 Shore C, approximately 48 Shore C or approximately 60 Shore C or approximately 65 Shore C, wherein the hardness is larger than of the midsole.

Embodiment 5: The sole of one of the preceding Embodiments, wherein the midsole material comprises a foam material.

Embodiment 6: The sole of the preceding Embodiment, wherein the midsole material comprises at least one of the following materials: a particle foam such as comprising at least one of the following materials: expanded thermoplastic polyurethane, eTPU, expanded polyamide, ePA, expanded polyether-block-amide, ePEBA, expanded thermoplastic polyester ether elastomer, eTPEE, expanded polylactide, ePLA, expanded polyethylene terephthalate, ePET, expanded polybutylene terephthalate, ePBT, and expanded thermoplastic olefin, eTPO; a block foam such as comprising at least one of the following materials: thermoplastic polyurethane, TPU, polyamide, PA, polyether-block-amide, PEBA, thermoplastic polyester ether elastomer, TPEE, polylactide, PLA, polyethylene terephthalate, PET, polybutylene terephthalate, PBT, and thermoplastic olefin TPO, ethylene-vinyl-acetate EVA.

Embodiment 7: The sole of one of the preceding Embodiments, wherein the at least one ground-contacting support element comprises a material with reinforcement, such as a material with fibers.

Embodiment 8: The sole of one of the preceding Embodiments, wherein the at least one ground-contacting support element is rod-shaped.

Embodiment 9: The sole of one of the preceding Embodiments, wherein the at least one ground-contacting support element is formed by at least one of the following manufacturing processes: injection molding or compression molding.

Embodiment 10: The sole of one of the preceding Embodiments, wherein the at least one ground-contacting support element is glued onto the midsole.

Embodiment 11: The sole of one of the preceding Embodiments, wherein a width of the at least one ground-contacting support element varies along said at least one ground-contacting support element.

Embodiment 12: The sole of one of the preceding Embodiments, wherein the at least one ground-contacting support element is rod-shaped and extends substantially parallel to the longitudinal extension direction of the sole.

Embodiment 13: The sole of the preceding Embodiment, wherein the at least one ground-contacting support element has a length of at least 15 cm, e.g., of at least 21 cm, and/or a width of at least 5 mm, e.g., of at least 9 mm.

Embodiment 14: The sole of one of the preceding Embodiments, wherein the at least one ground-contacting support element is not inserted in the midsole.

Embodiment 15: The sole of one of the Embodiments 1 to 13, wherein the at least one ground-contacting support element is at least partly inserted in the midsole.

Embodiment 16: The sole of the preceding Embodiment, wherein the midsole has at least one recess for receiving the at least one ground-contacting support element partially therein, such that the at least one ground-contacting support element protrudes from a surface of the midsole.

Embodiment 17: The sole of one of the preceding Embodiments, wherein the at least one ground-contacting support element protrudes at least 3 mm, e.g., at least 3.5 mm, from the midsole.

Embodiment 18: The sole of one of the preceding Embodiments, wherein the at least one ground-contacting support element is designed to allow at least one of the following functions: increase the traction of the sole, increase durability of the sole, increased wearing comfort, increased support of the sole, reduced weight of the sole, increased cushioning, increased energy return.

Embodiment 19: The sole of one of the preceding Embodiments, wherein the at least one ground-contacting support element has a shape comprising a localized low point relative to a horizontal plane, and wherein the localized low point is in the forefoot region of the sole.

Embodiment 20: The sole of one of the preceding Embodiments, wherein the at least one ground-contacting support element extends into the forefoot region of the sole.

Embodiment 21: The sole of the preceding Embodiment, wherein the at least one ground-contacting support element further extends rearwardly into the midfoot region of the sole.

Embodiment 22: The sole of the preceding Embodiment, wherein the at least one ground-contacting support element further extends rearwardly and into the heel region of the sole.

Embodiment 23: The sole of the Embodiments 20 to 22, wherein the at least one ground-contacting support element further extends into the medial and/or lateral region of the sole.

Embodiment 24: The sole of one of the preceding Embodiments, wherein the sole comprises at least two, or at least three support elements, each support element being rod-shaped.

Embodiment 25: The sole of the preceding Embodiment, wherein the at least two, e.g., at least three, ground-contacting support elements are tapered.

Embodiment 26: The sole of Embodiment 24 or 25, wherein there are exactly five ground-contacting support elements, each corresponding to a respective metatarsal bone.

Embodiment 27: A shoe, in particular a sports shoe such as a running shoe, comprising a sole of one of the preceding Embodiments.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

LIST OF REFERENCE SIGNS USED

100 sole
110 midsole
120 ground-contacting support element
130 connecting region

140 connecting region
150 additional cover element
200 sole
210 midsole
220 ground-contacting support element

The invention claimed is:

1. A sole for a shoe, comprising:

a midsole; and at least one ground-contacting support element comprising a foam material and being distinct from the midsole;

wherein the foam material of the at least one ground-contacting support element is stiffer than a midsole material; and wherein the at least one ground-contacting support element is rod-shaped and extends substantially parallel to the longitudinal extension direction of the sole.

2. The sole of claim 1, wherein the at least one ground-contacting support element provides at least 40% of a ground-contacting surface of the sole.

3. The sole of claim 1, wherein the foam material of the at least one ground-contacting support element comprises at least one of the following materials: ethylene-vinyl-acetate, EVA, or Ethylene Propylene Diene Monomer, EPDM, or combinations thereof.

4. The sole of claim 1, wherein the foam material of the at least one ground-contacting support element comprises a hardness of between 40 and 75 Shore C, wherein the hardness is larger than of the midsole.

5. The sole of claim 1, wherein the midsole material comprises a foam material.

6. The sole of claim 1, wherein the midsole material comprises at least one of the following materials: a particle foam comprising at least one of the following materials: expanded thermoplastic polyurethane, eTPU, expanded polyamide, ePA, expanded polyether-block-amide, ePEBA, expanded thermoplastic polyester ether elastomer, eTPEE, expanded polylactide, ePLA, expanded polyethylene terephthalate, ePET, expanded polybutylene terephthalate, ePBT, expanded thermoplastic olefin, eTPO; or combinations thereof; a block foam comprising at least one of the following materials: thermoplastic polyurethane, TPU, polyamide, PA, polyether-block-amide, PEBA, thermoplastic polyester ether elastomer, TPEE, polylactide, PLA, polyethylene terephthalate, PET, polybutylene terephthalate, PBT, thermoplastic olefin TPO, ethylene-vinyl-acetate EVA, or combinations thereof.

7. The sole of claim 1, wherein the at least one ground-contacting support element comprises a material with reinforcement.

8. The sole of claim 1, wherein the at least one ground-contacting support element is rod-shaped.

9. The sole of claim 1, wherein the at least one ground-contacting support element is formed by at least one of the following manufacturing processes: injection molding or compression molding.

10. The sole of claim 1, wherein the at least one ground-contacting support element is glued onto the midsole.

11. The sole of claim 1, wherein a width of the at least one ground-contacting support element varies along said at least one ground-contacting support element.

12. The sole of claim 1, wherein the at least one ground-contacting support element has a length of at least 15 cm.

13. The sole of claim 1, wherein the at least one ground-contacting support element is not inset within the midsole.

14. The sole of claim 1, wherein the at least one ground-contacting support element is at least partly inset within the midsole.

15. The sole of claim 1, wherein the midsole has at least one recess for receiving the at least one ground-contacting support element partially therein, such that the at least one ground-contacting support element protrudes from a surface of the midsole.

16. The sole of claim 1, wherein the at least one ground-contacting support element protrudes at least 3 mm from the midsole.

17. The sole of claim 1, wherein the at least one ground-contacting support element is designed to increase the traction of the sole, increase durability of the sole, increased wearing comfort, increased support of the sole, reduced weight of the sole, increased cushioning, increased energy return, or combinations thereof.

18. The sole of claim 1, wherein the at least one ground-contacting support element has a shape comprising a protrusion relative to the at least one ground-contacting support element, and wherein the protrusion is in the forefoot region of the sole.

19. The sole of claim 1, wherein the at least one ground-contacting support element extends into the forefoot region of the sole, extends rearwardly and into the heel region of the sole, or combinations thereof.

* * * * *